US011702275B2

(12) United States Patent
Chandra et al.

(10) Patent No.: US 11,702,275 B2
(45) Date of Patent: Jul. 18, 2023

(54) ACTIVE ATMOSPHERE CONTAINER SYSTEM WITH GAS MODULATING MEMBRANE FOR FOOD PRESERVATION

(71) Applicants: Shubham Chandra, Katy, TX (US); Benjamin Scott Williams, Walpole, MA (US)

(72) Inventors: Shubham Chandra, Katy, TX (US); Benjamin Scott Williams, Walpole, MA (US)

( * ) Notice: Subject to any disclaimer, the term of this patent is extended or adjusted under 35 U.S.C. 154(b) by 53 days.

(21) Appl. No.: 16/155,721

(22) Filed: Oct. 9, 2018

(65) Prior Publication Data

US 2020/0109003 A1 Apr. 9, 2020

(51) Int. Cl.
*B65D 85/34* (2006.01)
*B65D 81/24* (2006.01)
*B65B 25/04* (2006.01)

(52) U.S. Cl.
CPC ..... *B65D 85/345* (2013.01); *B65B 25/04* (2013.01); *B65D 81/24* (2013.01)

(58) Field of Classification Search
CPC ..... B65D 85/345; B65D 25/04; B65D 81/24
USPC ..... 442/76
See application file for complete search history.

(56) References Cited

U.S. PATENT DOCUMENTS

2013/0341236 A1* 12/2013 Chandra ..... B65D 85/345 206/524.3
2017/0219279 A1* 8/2017 Chae ..... F25D 29/005

FOREIGN PATENT DOCUMENTS

CN 103090623 A * 5/2013

OTHER PUBLICATIONS

Machine translation of cn 103090623 (Year: 2013).*

* cited by examiner

*Primary Examiner* — Vincent Tatesure

(57) ABSTRACT

This invention relates to a unique food preservation system that is used to extend the shelf life of food items by automatically modulating the gas composition within an air-tight container to the optimal atmospheric conditions for the specific food item(s) being stored in these containers. In order to extend the shelf life of food items, the optimal levels of carbon dioxide and oxygen must be maintained within the food storage container at all times. This is accomplished by constant real-time monitoring of the atmosphere within the food storage container and actively as well as passively controlling the atmosphere.

8 Claims, 1 Drawing Sheet

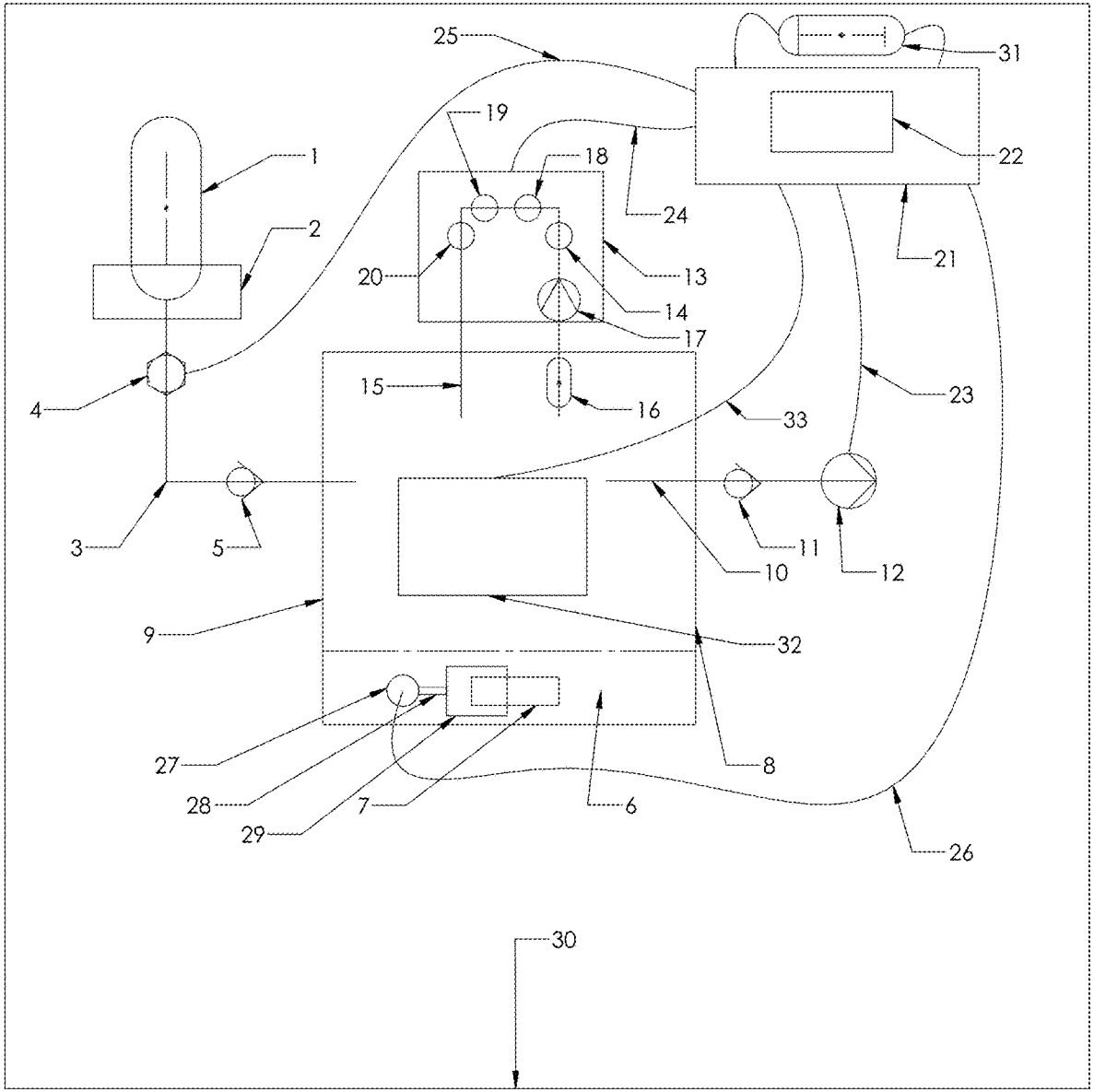
1
2
3
4
5
6
7
8
9
10
11
12
13
14
15
16
17
18
19
20
21
22
23
24
25
26
27
28
29
30
31
32
33

ACTIVE ATMOSPHERE CONTAINER SYSTEM WITH GAS MODULATING MEMBRANE FOR FOOD PRESERVATION

FIELD OF THE INVENTION

The invention relates to a unique food preservation system that is used to extend the shelf life of any food item (produce, meat, cheese, bread, seeds, coffee beans and other perishable commodities including beverages etc.) by intelligently modulating the gas composition within an air-tight container to the optimal atmospheric conditions for the specific food item(s) being stored in these containers.

BACKGROUND

Packaging may be termed active when it performs some role in the preservation of food other than providing an inert barrier to external conditions. The key focus of smart packaging systems is to match the package properties to those of the product being stored in it, and the result of this matching is therefore optimization of shelf life. The overall intent of such smart packaging systems is to add features to enhance the safety and shelf life of pre-packaged and processed food. Increased shelf life offers advantages such as reduction in food losses, increased profitability and expanding the geographical boundaries for the farm to fork model.

The tissues in fresh produce are still living and deriving energy, primarily through the process of respiration. Respiration involves the consumption, using atmospheric oxygen (O2), of carbohydrates and organic acids and the consequent production of metabolic energy, heat, carbon dioxide (CO2) and moisture vapor. Different fruits and vegetables, and even different varieties of a given fruit or vegetable, will vary in their respiration rates. The use of reduced oxygen (O2) and/or elevated carbon dioxide (CO2) to extend the post-harvest life of fruits and vegetables may be useful in some cases. However, the use of gases is complicated by the fact that different food products require different atmospheres conditions; for example, the mix of O2 and CO2 that will be beneficial for strawberries will be damaging to oranges, tomatoes and many other products. Therefore, one of the major limitations for packages with regards to horticultural produce commodities is the inability to offer a wide range of CO2:O2 permeability ratios. Active MAP (Modified Atmospheric Packaging) based smart packaging systems introduce a desired gas mixture into the produce's packaging prior to or after sealing, thereby accelerating the process of achieving an optimized atmosphere. The shelf life of meat based products depend upon extrinsic factors such as different gas atmospheres, storage temperatures, and intrinsic factors such as chemical composition of the product. With regards to fish, the loss of shelf life is directly related to microbial and oxidation activity. The microbial activity causes the decay of the proteins in fish leading to an undesirable odor. Further oxidation of unsaturated fats in fish leads to unpleasant aromas and flavors. The shelf life of cooked meats is limited by the growth of spoilage bacteria, as well as pathogens.

Spoilage in fresh meat and poultry can be caused by a range of bacteria including lactic acid bacteria, *Pseudomonas, Aeromonas* and *Enterobacter.*

Meat products have been commercialized predominantly as frozen products due to the longer shelf life provided by freezing when compared to refrigeration. However, based upon the current trend of increased demand for fresh and ready-meal products, there is an increasing need for refrigerated meat products. The Active MAP based smart packaging system could be used to extend the shelf life of meat products stored under refrigeration when compared to the traditional vacuum packaging.

SUMMARY

Some shortcomings of passive packaging systems include the inability to establish ideal oxygen and carbon dioxide atmospheric levels inside the packaging expeditiously. Highly permeable films, even with OPR (Oxygen Permeation Rates) up to 110,000 cc/100 in2/day/atm, or even up to 960,000 cc/100 in2/day/atm, with carbon dioxide permeability of at least 350,000 cc/100 in2/day typically takes 6-12 hours to achieve steady state conditions for carbon dioxide, and 12-24 hours to achieve steady state conditions for oxygen. In the event of daily openings of the packaging, these steady state conditions can never be achieved.

Further, many of the packaging systems in use control and/or inhibit the oxygen levels within the package with the use of oxygen absorbents/scavengers/anti-oxidants. However, controlling the oxygen levels does not guarantee shelf life, because the technology may fail to completely inhibit the growth of facultative or anaerobic bacteria or reduce the oxygen to an acceptable level due to package leakage or limitations with the oxygen scavenging technology. Also limited research is available to control the diffusion rate of the bioactive compounds in packaging meat and meat products during storage for maximum effectiveness.

Still further, certain packaging systems generate carbon dioxide inside packages to help create an environment that is unfavorable for microbial growth on fresh and processed meats, poultry, seafood and other food products. Carbon dioxide can retard the growth of aerobic microorganisms by extending both the germination time and lag phase of spoilage organisms due to the ability of intra-cellular pH changes. However, lactic acid bacteria can be stimulated by Carbon Dioxide, and absorption of the carbon dioxide on the meat/fish products have been known to increase the acidity of the meat which produces an undesirable flavor. Furthermore, certain pathogens are minimally affected by carbon dioxide levels lower than 50%, and there is a concern that by inhibiting aerobic microorganisms, a food product may appear edible while containing a high quantity of anaerobic pathogens that have multiplied due to a lack of competition and reduced oxygen levels.

Furthermore, many packaging technologies use low levels of Carbon Monoxide to maintain the red color stability of red meat such as steaks, which could be related to the phenomena that CO MAP significantly increased metmyoglobin reducing activity, and remained stable during storage.

Accordingly, there remains room for improvement in areas of food preservation that can work across different food types and that are used to extend the shelf life of any food item (produce, meat, cheese, bread, seeds, coffee beans and other perishable commodities including beverages etc.)

The objective of the invention is, therefore, to provide a packaging system with a passive highly permeable film coupled with an active CO2 injection system and vacuum pump which are automatically controlled by a digital logic controller which is running off of algorithms that when coupled with a suite of sensors monitoring the gas within the container, allow for the optimal atmosphere for any food item to be achieved and maintained throughout the duration of the time the food items are stored. The passive highly permeable film is used to ensure anaerobic conditions are not achieved in certain circumstances as well as provides a means to passively cycle oxygen and CO2 levels within the storage container without any power. Cycling CO2 levels from high to low and oxygen levels from low to high multiple times over the course of storage, especially for meat products, has shown to improve taste, smell, and the color of the food while reducing bacterial growth enough to significantly extend shelf life.

A particular configuration of the highly permeable fabric based film is obtained by coating a permeable film with a thin layer of polymer, the coated system gets its structural strength from the film and the permeability from the polymer. This approach enables a reduction in the thickness of the polymer coating on the film, and yet maintains enough strength and durability with the film as to allow it to be attached to a container and used for an extended period of time. The Oxygen Permeation Rate of this film ranges from 110,000 cc/100 in2/day/atm up to 960,000 cc/100 in2/day/atm, with carbon dioxide permeability of at least 350,000 cc/100 in2/day/atm, with a maximum permeability of 3, 888, 889 cc/100 in2/day/atm at 13° C.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

The Food Preservation System comprises of an air-tight food storage container (8) with a lid (6) and a base (9). The container lid (6) is capable of being opened as to access any food items stored within the container base (9).

In order to extend the shelf life of food items, the optimal levels of carbon dioxide and oxygen must be maintained within the food storage container (8) at all times. This is accomplished by constant real-time monitoring of the atmosphere within the food storage container (8); whereby the gas mixture within the container (8) is pulled into the sensor array (13) via the sensor array pump (17) and sensor array gas tube (15). This gas is first passed through a water trap (16) and then is passed through a carbon dioxide sensor (14), oxygen sensor (18), temperature sensor (19) and humidity sensor (20). The gas is then allowed to exit back into the container (8) for recirculation. The electronic readings from the sensor array (13) are then sent to the data logic controller (21).

Based on the readings from the sensors, and what food items are selected for storage by the user via the user touch screen interface (22), the data logic controller (21) activates the carbon dioxide solenoid (5), vacuum pump (12) and membrane exposure panel motor (27) to modulate the atmosphere within the container to the optimal levels for the food items being stored. The algorithm for run time of the carbon dioxide injection, position of the membrane surface area exposure panel and vacuum pump run time varies depending on the food item(s) being stored, but can include any combination of membrane (7) surface area exposure; which is controlled by the membrane surface area exposure panel (29) which can limit the membrane surface area which is exposed to the ambient atmosphere and is connected to the membrane exposure area motor (27) by a mechanical linkage (28); carbon dioxide injection time, which is controlled by the carbon dioxide solenoid valve (4) which allows pressurized carbon dioxide to flow from the carbon dioxide pressurized cartridge (1) through the carbon dioxide gas tube (3), carbon dioxide solenoid valve (4), one way carbon dioxide gas valve (5) and pass into the air tight food storage container (8); vacuum pump (12) run time, which draws gas from the air tight food storage container (8) via the vacuum tube (10) which passes through the one way vacuum gas valve (11) before entering the vacuum pump (12) and being expelled outside of the air tight food storage container (8); and storage food item weight, which can be detected by the integrated digital scale (32).

The carbon dioxide solenoid valve (4) is connected to the data logic controller (21) by electrical wire 25. The membrane exposure area motor (27) is connected to the data logic controller by electrical wire 26. The sensor array (13) is connected to the data logic controller by electrical wire 24. The integrated digital scale (32) is connected to the data logic controller by electrical wire 33. The data logic controller is powered by power source 31, which may be any form of battery or shore power. All system power is controlled through the data logic controller (21).

The carbon dioxide pressurized cartridge (1) can be threaded into the cartridge receptacle fitting (2) as to allow the carbon dioxide pressurized cartridge (1) to be removed and replaced when the gas is depleted. The cartridge receptacle fitting (2) can also be connected to non-cartridge constant flow source of carbon dioxide.

The membrane (7) is capable of utilizing the partial pressure within the air tight container (8) to transfer carbon dioxide within the container to the ambient environment and oxygen from the ambient environment to the inside of the air tight container at a ratio of 1 oxygen molecule to every 6 carbon dioxide molecules. The membrane is also hydrophobic and does not allow moisture to pass through.

The entire Food Preservation System (30) may be integrated into a larger but man transportable container as to make the system capable of standalone operation. In such a standalone configuration the Food Preservation System system (30) could be placed into a larger refrigerated container, but would nut be permanently integrated into the refrigeration system.

The Food Preservation System system (30) could also be permanently integrated into or coupled with a refrigeration system as to provide cooling capacity to the air tight container (8) to cool the contained food items.

What is claimed is:

1. A Preservation System including an air-tight food storage container comprising a film which comprises a fabric substrate and a coating on the fabric substrate having an oxygen permeability of at least 100 cc/100 in2/day/atm and having a carbon dioxide permeability of at least 600 cc/100 in2/day/atm and at most 3,888,889 cc/100 in2/day/atm; further comprising a carbon dioxide solenoid, sensor, data logic controller, touch screen interface, membrane exposure panel, digital scale, wherein the data logic controller and the touch screen user interface, based upon the food items being stored and their respective weights measured by the integrated digital scale, automatically activates the carbon dioxide solenoid to allow a specific amount of CO2 to enter the container while additionally activating a vacuum pump for a specific amount of time and activating a membrane exposure panel motor to adjust the exposed surface area of the film in order to modulate the atmosphere within the container to the optimal levels for the multiple food items being stored, and further comprising a sensor array that provides real time monitoring of the atmosphere within the food storage container to provide continued automatic operation; whereby the gas mixture within the container is pulled into the sensor array via a sensor array pump and a sensor array gas tube and recirculated back into the container.

2. A Preservation System including an air-tight food storage container comprising a film which comprises a fabric substrate and a coating on the fabric substrate having an oxygen permeability of at least 100 cc/100 in2/day/atm with a maximum permeability of 960,000 cc/100 in2/day/atm; and further comprising a carbon dioxide solenoid, sensor, data logic controller, touch screen interface, membrane exposure panel, digital scale, wherein the data logic controller and the touch screen user interface, based upon the food items being stored and their respective weights measured by the integrated digital scale, automatically activates the carbon dioxide solenoid to allow a specific amount of CO2 to enter the container while additionally activating a vacuum pump for a specific amount of time and activating a membrane exposure panel motor to adjust the exposed surface area of the film in order to modulate the atmosphere within the container to the optimal levels for the multiple food items being stored, and further comprising a sensor array that provides real time monitoring of the atmosphere within the food storage container to provide continued automatic operation; whereby the gas mixture within the container is pulled into the sensor array via a sensor array pump and a sensor array gas tube and recirculated back into the container.

3. A Preservation System including an air-tight food storage container comprising a film which comprises a fabric substrate and a coating on the fabric substrate having a carbon dioxide permeability of at least 600 cc/100 in2/day/atm with and at most 3,888,889 cc/100 in2/day/atm; and further comprising a carbon dioxide solenoid, sensor, data logic controller, touch screen interface, membrane exposure panel, digital scale, wherein the data logic controller and the touch screen user interface, based upon the food items being stored and their respective weights measured by the integrated digital scale, automatically activates the carbon dioxide solenoid to allow a specific amount of CO2 to enter the container while additionally activating a vacuum pump for a specific amount of time and activating a membrane exposure panel motor to adjust the exposed surface area of the film in order to modulate the atmosphere within the container to the optimal levels for the multiple food items being stored, and further comprising a sensor array that provides real time monitoring of the atmosphere within the food storage container to provide continued automatic operation; whereby the gas mixture within the container is pulled into the sensor array via a sensor array pump.

4. The preservation system according to claim 1, further configured to integrate into permanently affixed drawers and/or cabinets.

5. The preservation system according to claim 1, wherein the preservation system extends the shelf life of banana to a minimum of 8 days and to a maximum of 18 days.

6. The preservation system according to claim 1, wherein the preservation system extends the shelf life of salmon to a minimum of 8 days and to a maximum of 15 days.

7. The preservation system according to claim 1, wherein the preservation system extends the shelf life of lunch meat (turkey) to a minimum of 8 days and to a maximum of 15 days.

8. The preservation system according to claim 1, wherein the preservation system extends the shelf life of strawberries to a minimum of 13 days and to a maximum of 30 days.

* * * * *